US012655711B1

(12) United States Patent
Siok et al.

(10) Patent No.: US 12,655,711 B1
(45) Date of Patent: Jun. 16, 2026

(54) RESETTABLE, RETRIEVABLE MULTI-SIZE DONUT SEAL

(71) Applicant: Halliburton Energy Services, Inc., Houston, TX (US)

(72) Inventors: Xue Yuan Siok, Singapore (SG); Nithin Kumar Gupta Dachepally, Singapore (SG); Jalpan P. Dave, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/169,346

(22) Filed: Apr. 3, 2025

(51) Int. Cl.
*E21B 33/12* (2006.01)
*E21B 23/01* (2006.01)

(52) U.S. Cl.
CPC ..... *E21B 33/1208* (2013.01); *E21B 23/01* (2013.01)

(58) Field of Classification Search
CPC ..... E21B 33/1208; E21B 23/01
See application file for complete search history.

(56) References Cited

U.S. PATENT DOCUMENTS 2,701,615 A * 2/1955 Riordan, Jr. ..... E21B 33/1208 277/331
2,738,013 A * 3/1956 Lynes ..... E21B 33/124 166/147
2,738,018 A * 3/1956 Lynes ..... E21B 33/124 166/147
2,767,794 A * 10/1956 Lynes ..... E21B 33/124 277/340
2,872,230 A * 2/1959 Desbrandes ..... E21B 33/1277 166/187
2,997,107 A * 8/1961 Lynes ..... E21B 33/124 166/185
3,706,342 A * 12/1972 Woolley ..... E21B 23/06 166/134
3,776,561 A * 12/1973 Haney ..... E21B 33/1208 277/340

(Continued)

FOREIGN PATENT DOCUMENTS

CN 115434657 12/2022
WO 2024067533 4/2024

OTHER PUBLICATIONS

"PCT Application No. PCT/US2025/024432 International Search Report and Written Opinion", Dec. 22, 2025, 16 pages.

*Primary Examiner* — Steven A Macdonald
(74) *Attorney, Agent, or Firm* — DeLizio, Peacock, Lewin & Guerra LLP

(57) ABSTRACT

A sealing assembly and a method of moving the sealing assembly between a radially retracted state and a radially expanded state. A sealing assembly is positioned in a wellbore. The sealing assembly includes a first collar sleeve, a second collar sleeve, a sealing element disposed between the first and second collar sleeves and one or more backing plates disposed behind the sealing element. Sliding the first and second collar sleeves closer together sets the sealing element by forcing the sealing element outward and by extending the one or more backing plates to contact an inside surface of the sealing element. Sliding the first and second collar sleeves apart unsets the sealing element, retracting the one or more backing plates and allowing the sealing element to relax into an approximately original position.

16 Claims, 8 Drawing Sheets

(56) References Cited

U.S. PATENT DOCUMENTS 3,784,214 A * 1/1974 Tamplen ..... E21B 33/1208 277/341
4,545,433 A * 10/1985 Wambaugh ..... E21B 33/1216 166/135
4,554,973 A * 11/1985 Shonrock ..... E21B 33/1216 166/387
4,671,356 A * 6/1987 Barker ..... E21B 33/134 166/386
4,720,113 A * 1/1988 Hertz, Jr. ..... F16J 15/20 277/342
RE32,831 E * 1/1989 Shonrock ..... E21B 33/1293 166/135
5,010,958 A * 4/1991 Meek ..... E21B 33/1265 166/134
5,340,626 A * 8/1994 Head ..... E21B 33/1277 428/184
5,404,946 A * 4/1995 Hess ..... E21B 33/1275 166/325
7,178,602 B2 * 2/2007 Hiorth ..... E21B 33/1216 166/382
9,085,970 B2 * 7/2015 Xiao ..... E21B 43/12
9,291,028 B2 * 3/2016 Hiorth ..... E21B 33/1208
9,528,341 B2 12/2016 Slup
9,945,205 B2 * 4/2018 Hiorth ..... E21B 33/128
10,081,998 B2 * 9/2018 Tunget ..... E21B 27/00
10,100,600 B2 * 10/2018 Lastra ..... E21B 43/105
10,253,592 B2 4/2019 Ingram et al.
10,612,339 B2 4/2020 Murphy
10,648,277 B2 * 5/2020 Stormo ..... E21B 23/06
11,118,421 B2 * 9/2021 Machocki ..... E21B 33/06
11,339,625 B2 * 5/2022 Brown ..... E21B 33/1216
11,492,869 B2 11/2022 Urban et al.
11,542,775 B2 1/2023 Horne et al.
12,312,900 B2 * 5/2025 Hiorth ..... E21B 17/1078
2004/0194969 A1 * 10/2004 Hiorth ..... E21B 33/128 166/387
2005/0000692 A1 * 1/2005 Cook ..... E21B 33/12 166/309
2006/0272806 A1 * 12/2006 Wilkie ..... E21B 33/1208 166/192
2012/0118559 A1 5/2012 Li et al.
2013/0333875 A1 * 12/2013 Hiorth ..... E21B 33/128 166/179
2015/0152704 A1 * 6/2015 Tunget ..... E21B 17/05 166/299
2015/0247374 A1 * 9/2015 Hiorth ..... E21B 33/1216 166/196
2018/0142529 A1 * 5/2018 Macdonald ..... E21B 33/128
2018/0245423 A1 * 8/2018 Stormo ..... E21B 33/128
2018/0320474 A1 * 11/2018 Clemens ..... E21B 33/134
2018/0363406 A1 * 12/2018 Kao ..... E21B 33/128
2019/0120011 A1 4/2019 Kellner
2019/0186229 A1 * 6/2019 Hrupp ..... E21B 33/124
2019/0323316 A1 * 10/2019 Brown ..... E21B 33/1208
2021/0071496 A1 * 3/2021 Brown ..... E21B 33/128
2021/0215016 A1 * 7/2021 Machocki ..... E21B 47/08
2022/0268116 A1 8/2022 Brown et al.
2023/0417121 A1 * 12/2023 Carragher ..... E21B 36/008
2024/0287866 A1 * 8/2024 Hiorth ..... E21B 33/1204
2025/0043653 A1 * 2/2025 Gar ..... E21B 33/128

* cited by examiner

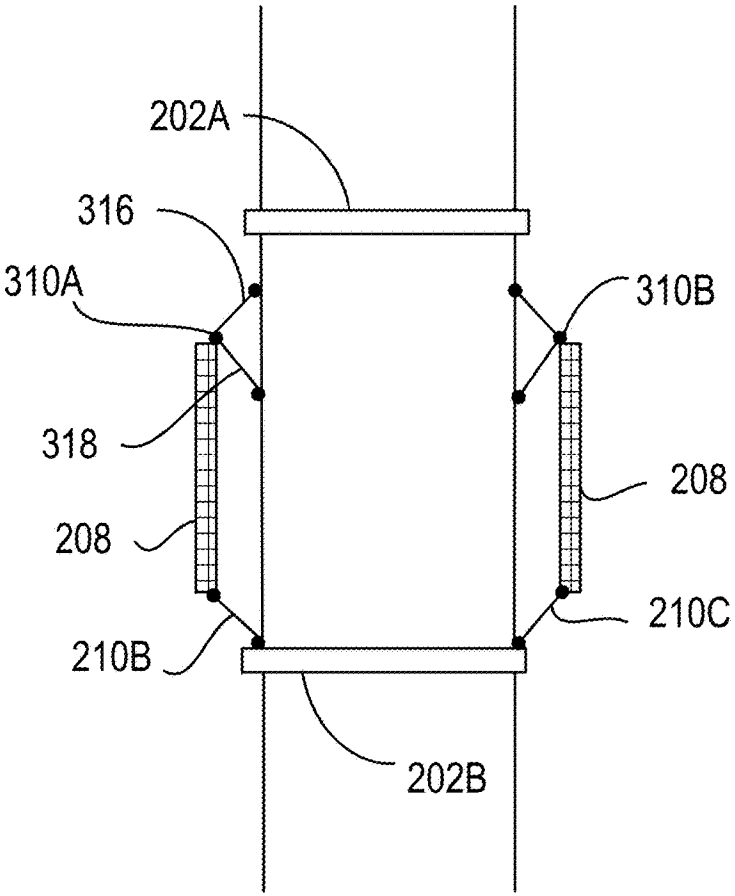
FIG. 6B
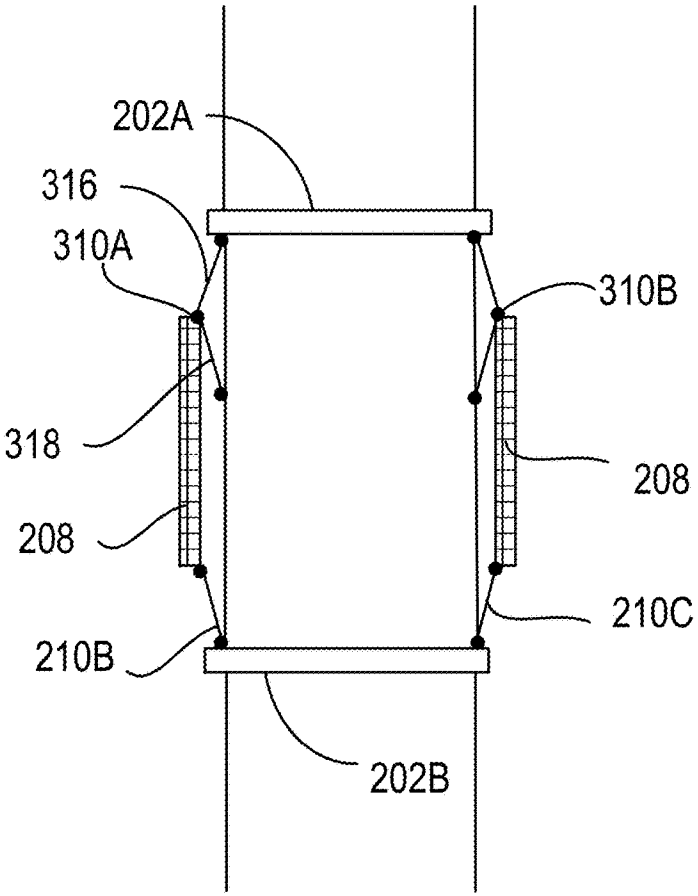
FIG. 6A
FIG. 6

RESETTABLE, RETRIEVABLE MULTI-SIZE DONUT SEAL

BACKGROUND

A typical downhole tool (e.g., packer, bridge plug, frac plug, anchor, etc.) generally has one or more radially extending elements that are employed to provide a fluid-tight seal or anchor radially between a mandrel of the downhole tool, and the casing or wellbore into which the downhole tool is disposed. Such a downhole tool is commonly conveyed into a subterranean wellbore suspended from tubing extending to the earth's surface.

To prevent damage to the radially extending elements of the downhole tool while the downhole tool is being conveyed into the wellbore, the radially extending elements may be carried on the mandrel in a retracted or uncompressed state, in which they are radially inwardly spaced apart from the casing. When the downhole tool is set, the radially extending elements radially expand, thereby providing the fluid-tight seal or anchor between the mandrel and the casing and/or wellbore.

BRIEF DESCRIPTION OF THE DRAWINGS

Embodiments of the disclosure may be better understood by referencing the accompanying drawings.

FIGS. 3A-3F are cross-sectional views of a deployment state of an example scaling assembly that may be used in the example well system of FIG. 1, according to aspects of the present disclosure.

FIGS. 6A and 6B are cross-sectional views of deployment states of another hinge combination that may be used in the example sealing assemblies of FIGS. 2, 3A-3F and 5A and 5B, according to aspects of the present disclosure.

Like reference numbers and designations in the various drawings indicate like elements.

DETAILED DESCRIPTION

Figure 1:
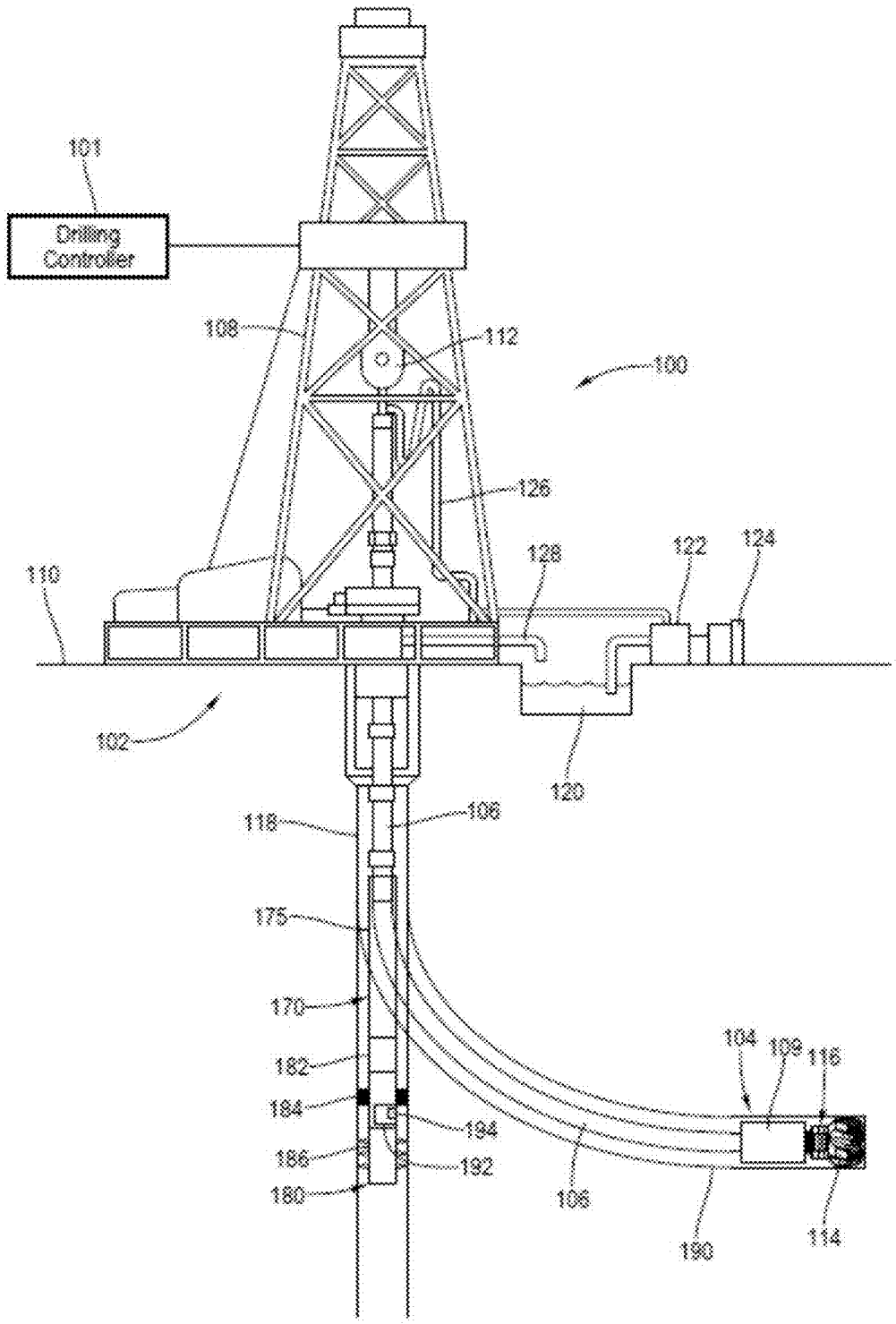
FIG. 1 is an elevation view in partial cross section of an example well system that supports deployment of downhole tools, according to aspects of the present disclosure.

The description that follows includes example systems, methods, techniques, and program flows that embody embodiments of the disclosure. Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Retrievable bridge plugs are mechanical devices used to isolate sections of a wellbore temporarily. Retrievable bridge plugs may be used with coiled tubing or drill pipe, are designed to be set at a specific depth within the well and may be retrieved when their purpose has been fulfilled. This makes them highly versatile and valuable for various well operations. Retrievable bridge plugs may be used to temporarily isolate a specific well section from the well system (e.g., during fracking) or may be deployed as a pressure barrier between different sections of a well. Retrievable bridge plugs with wireline controls provide precise and controlled deployment options.

In operation, the bridge plug may be lowered into the wellbore to a desired depth, anchored in place and deployed to seal the wellbore. In one example approach, an expandable element in the bridge plug is expanded in the wellbore until it grips the walls of the wellbore securely. The plug creates a pressure-tight seal, isolating the section of the wellbore below the plug. The isolation allows for various operations to be conducted above the plug without interference.

When the operation is complete, the plug is retrieved by reversing the setting process. When the expandable element has contracted, the plug may be retrieved from the wellbore. Retrievable bridge plugs have a maximum performance limit of 10 k psi and 300° F. In High Pressure High Temperature (HPHT) applications, however, temperatures may rise to 400° F. and pressures may be as high as 15 k psi.

A resettable, multi-size donut seal is described herein. The resettable, multi-size donut seal may be set and unset with minimal damage to elastomers. To set the device, in one example approach, a top end ring slides down a mandrel, forcing the elastomers to balloon radially. At the same time, backing plates behind the elastomers extend radially to support the elastomers. To unset the device, the top end ring slides up to reverse the setting process.

In another example approach, to set the device, a bottom end ring slides up a mandrel, forcing the elastomers to balloon radially. At the same time, backing plates behind the elastomers extend radially to support the elastomers. To unset the device, the bottom end ring slides down the mandrel to reverse the setting process.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

Example Well System

In FIG. 1 is an elevation view in partial cross section of an example well system that supports directional drilling, according to aspects of the present disclosure. In the example shown in FIG. 1, the well system 100 includes a drilling controller 101 used to direct a drill bit 114 (in drilling a wellbore 118 through a subterranean formation 102, such as a subsea well or a land well. Example embodiments are not limited to only drilling an oil well. Some implementations may also encompass natural gas wellbores, other hydrocarbon wellbores, or wellbores in general. Further, some implementations may be used for the exploration and formation of geothermal wellbores intended to provide a source of heat energy instead of hydrocarbons.

In the example shown in FIG. 1, well system 100 includes a drill string 106 attached to a derrick 108 and a bottom hole assembly (BHA) 104; the BHA 104 may be positioned or otherwise arranged at the bottom of the drill string 106. The derrick 108 may be located at the surface 110 and may, in some example approaches, include a kelly 112 connected to drill string 106; the kelly 112 may be used, for instance, to lower and raise the drill string 106 or to raise and lower a scaling/anchoring assembly 180.

The BHA 104 may include a drill bit 114, a rotary steerable system (RSS) 109, other suitable components, or a combination thereof. The drill bit 114 may, in some examples, be operatively coupled to a tool string 116, with the tool string 116 attached to the drill string 106 such that the drill bit 114 may be moved axially within drilled wellbore 118. During operation, the drill bit 114 may penetrate the subterranean formation 102 to extend the wellbore 118.

The BHA 104 may control the drill bit 114 as the BHA 104 advances into the subterranean formation 102. For example, the BHA 104 may use the rotary steerable system 109 to change a direction of drilling by applying a steering pressure or other suitable force to a wall of the wellbore 118.

In the example shown in FIG. 1, fluid such as a drilling mud may be pumped downhole from a mud tank 120 using a mud pump 122 that may be powered by an adjacent power source, such as a prime mover (or motor) 124. The mud may be pumped from the mud tank 120, through a standpipe 126, which feeds the mud through the drill string 106 to the rotary steerable system 109, or other suitable components of the well system 100, and on to the drill bit 114. The mud may, in some examples, exit one or more nozzles (not shown) arranged in the drill bit 114 and may thereby cool the drill bit 114. Additionally, or alternatively, the mud may be directed (e.g., as pressurized mud) into the rotary steerable system 109 for adjusting a direction of the drill bit 114, as discussed in further detail below.

After exiting the drill bit 114 or other suitable component, the mud may circulate back to the surface 110 via an annulus 119 defined between the wellbore 118 and the drill string 106. The returning mud transports cuttings from the wellbore 118 through flow line 128 into the mud tank 120 and aids in maintaining the integrity of the wellbore 118. For example, cuttings and mud mixture passed from the annulus 119 through the flow line 128 may be processed such that a cleaned mud is returned down hole through the standpipe 126.

The tool string 116 may include one or more logging while drilling (LWD) or measurement-while-drilling (MWD) tools that collect data and measurements relating to various borehole and formation properties as well as the position of the drill bit 114 and various other drilling conditions as the drill bit 114 extends the wellbore 118 through the formations 102. The Logging While Drilling (LWD)/(MWD) tools may include a device for measuring formation resistivity, a gamma ray device for measuring formation gamma ray intensity, devices for measuring the inclination and azimuth of the BHA 104, pressure sensors for measuring drilling fluid pressure, temperature sensors for measuring borehole temperature, etc.

In the example shown in FIG. 1, RSS 109 is configured to change the direction of the tool string 116 and/or the drill bit 114, such as based on information indicative of tool orientation and a desired drilling direction received from a drilling application. In one or more example approaches, the RSS 109 is coupled to the drill bit 114 and may drive rotation of the drill bit 114. Specifically, the RSS 109 may rotate in tandem with the drill bit 114 or may rotate at a fraction of the rate of drill bit 114. In some implementations, the rotary steerable system 109 may be a point-the-bit system or a push-the-bit system.

In the example well system of FIG. 1, wellbore 118 is a "main" wellbore that has been drilled through the various earth strata, including the subterranean formation 102. The term "main" wellbore is used herein to designate a wellbore from which another wellbore is drilled. It is to be noted, however, that a main wellbore 118 does not necessarily extend directly to the earth's surface but could instead be a branch of yet another wellbore. A casing string (not shown) may be at least partially cemented within the main wellbore 118. The term "casing" is used herein to designate a tubular string used to line a wellbore. Casing may be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the example approach of FIG. 1, a whipstock assembly 170 is positioned at a location in the main wellbore 118. Specifically, the whipstock assembly 170 could be placed at a location in the main wellbore 118 where it is desirable for a lateral wellbore 190 to exit. Accordingly, the whipstock assembly 170 may be used to support a milling tool used to penetrate a window in the main wellbore 118, and once the window has been milled and a lateral wellbore 190 formed, in some example approaches, the whipstock assembly 170 may be retrieved and returned uphole by a retrieval tool.

The whipstock assembly 170, in at least one example approach, includes a whipstock element section 175, as well as a sealing/anchoring assembly 180 coupled to a downhole end thereof. The scaling/anchoring assembly 180, in one or more example approaches, includes an orienting receptacle tool assembly 182, a sealing assembly 184, and an anchoring assembly 186. The orienting receptacle tool assembly 182, in one or more example approaches, along with a collet and one or more orienting keys, may be used to land and position a guided milling assembly and/or the whipstock element section 175 within the main wellbore 118. The sealing assembly 184, in at least one example approach, seals (e.g., provides a pressure tight seal) an annulus 188 between the whipstock assembly 170 and the main wellbore 118. In at least one example approach, the anchoring assembly 186 axially, and optionally rotationally, fixes the scaling/anchoring assembly 180 within the main wellbore 118.

The elements of the whipstock assembly 170 may be positioned within the main wellbore 118 in one or more separate steps. In at least one example approach, the scaling/anchoring assembly 180, including the orienting receptacle tool assembly 182, sealing assembly 184 and the anchoring assembly 186, may be run in hole first, and then set within main wellbore 118. The scaling assembly 184 may then be pressure tested. The whipstock element section 175 may then be run in hole and coupled to the sealing assembly 184, for example using the orienting receptacle tool assembly 182, resulting in the whipstock assembly 170 shown in FIG. 1.

In the example approach shown in FIG. 1, the sealing assembly 184 may be located within an open-hole section of the wellbore 118. In other example approaches, however, the scaling assembly 184 may be located within a casing or other tubular element (not shown). The kelly 112 may be used to lower and raise the sealing/anchoring assembly 180.

Although the example shown in FIG. 1 is a directional drilling application, scaling assembly 184 may be used in almost any application where one wishes to isolate sections of a wellbore temporarily. In one example approach, retrievable bridge plugs such as scaling assembly 184 may be used with coiled tubing or drill pipe, are designed to be set at a specific depth within the well and may be retrieved when their purpose has been fulfilled. They may be used to temporarily isolate a specific well section from the well system (e.g., during fracking) or may be deployed as a pressure barrier between different sections of a well. Retrievable bridge plugs with wireline controls provide precise and controlled deployment options.

In operation, the sealing assembly 184 may be lowered into the wellbore 118 to a desired depth, anchored in place and deployed to seal the wellbore 118. In one example approach, an expandable element in the sealing assembly 184 is expanded in the wellbore 118 until it grips the walls of the wellbore 118 securely. The sealing assembly 184 creates a pressure-tight seal, isolating the section of the wellbore below the plug. The isolation allows for various operations to be conducted above sealing assembly 184 without interference.

Figure 2:
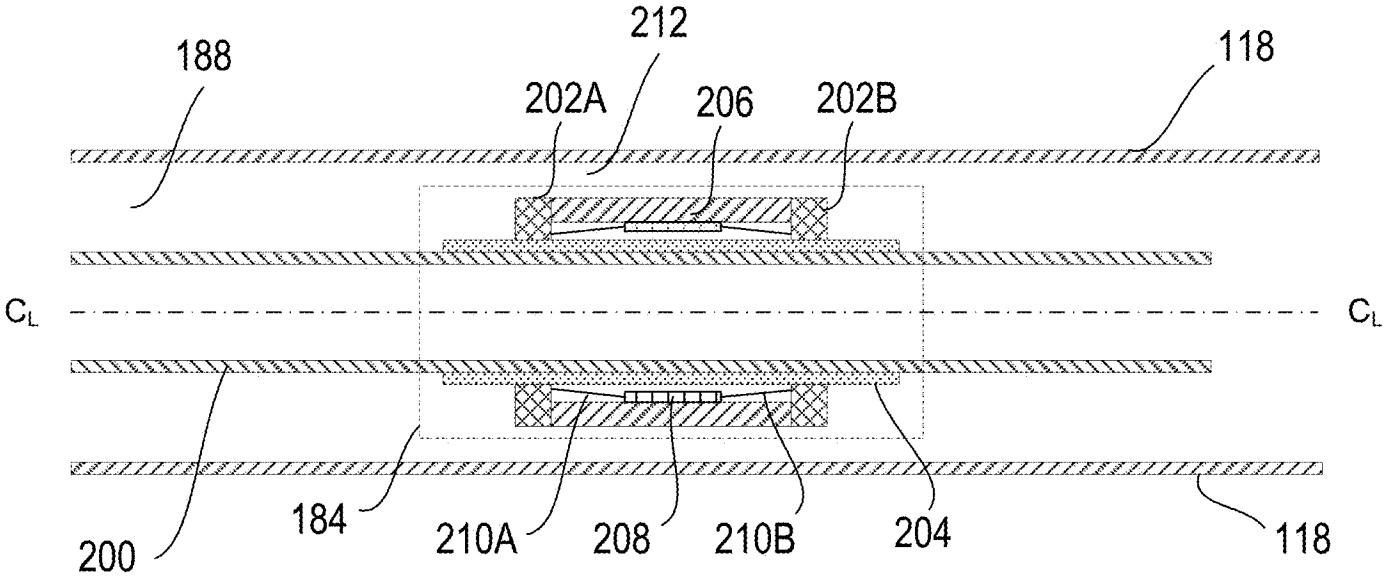
FIG. 2 is a cross-sectional view of a deployment state of an example sealing assembly that may be used in the example well system of FIG. 1, according to aspects of the present disclosure.

FIG. 2 is a cross-sectional view of a deployment state of an example sealing assembly that may be used in the example well system of FIG. 1, according to aspects of the present disclosure.

In the example shown in FIG. 2, sealing assembly 184 includes a mandrel 204. The mandrel 204, in the illustrated example, may be centered about a centerline (CL) of tubing 200. The mandrel 204, in one or more example approaches, is a tubular mandrel such as an inner tubular surrounding a portion of tubing 200. In some example approaches the wellbore 118 is an open-hole wellbore. In some example approaches, the wellbore 118 includes an outer tubular positioned within a wellbore, such as casing, production tubing, or other tubular element (not shown).

In the example approach shown in FIG. 2, the sealing assembly 184 includes a scaling element 206 (e.g., an elastomeric sealing element). The sealing element 206, in one or more example approaches, is operable to move between a radially retracted state, such as that shown in FIGS. 2, 3A, 3B, 3E and 3F, and a radially expanded state, such as that shown in FIGS. 3C and 3D. While a single scaling element 206 is illustrated in FIG. 2, in other example approaches, two or more sealing elements 206 may be employed, whether together or spaced apart in series along the mandrel 204. In one example approach, the sealing element 206 may include a non-swellable elastomer, among other types and materials. In some example approaches, sealing element 206 includes an access hole (not shown) in the center or to the side of the sealing element 206 and strategically placed to allow fluid to creep below or behind the seal of sealing element 206 with the casing or wellbore. In one such example approach, the access hole reduces void or negative pressure zone that may impact the sealing performance of the sealing element 206.

Although the example shown in FIG. 2 may be used in a directional drilling application such as shown in FIG. 1, donut seals as shown in FIG. 2 may also be used in almost any application where one wishes to isolate sections of a wellbore temporarily. A sealing assembly 184 with a scaling element 206 configured as a donut seal may be used with coiled tubing or drill pipe, is designed to be set at a specific depth within the well and may be retrieved when its purpose has been fulfilled. It may be used to temporarily isolate a specific well section from the well system (e.g., during fracking) or may be deployed as a pressure barrier between different sections of a well. Retrievable bridge plug applications based on scaling assembly 184 may be deployed with wireline controls, providing precise and controlled deployment options.

In operation, the sealing assembly 184 may be lowered into the wellbore 118 to a desired depth, anchored in place and deployed to seal the wellbore 118. In one example approach, an expandable element (such as sealing element 206 in the sealing assembly 184) is expanded in the wellbore 118 until it grips the walls of the wellbore 118 securely. The sealing element 206 creates a pressure-tight seal, isolating the section of the wellbore 118 below the scaling assembly 184. The isolation allows for various operations to be conducted above sealing assembly 184 without interference.

In some example approaches, as shown in FIGS. 2 and 3A-3F, first and second collar sleeves (202A and 202B, respectively) straddle ends of the sealing element 206. In some example approaches, scaling assembly 184 includes an anchoring element that includes one or more anchoring features thereon (such as, for example, the anchoring features shown in anchoring assembly 186 in FIG. 1). In the examples shown in FIGS. 2 and 3A-F, sealing assembly further includes a backing plate 208 connected by backing plate hinges 210 to collar sleeves 202A and 202B. In one such example approach, the sealing element 206 is bonded to the collar sleeves 202 to prevent leak paths from below sealing element 206 and to provide additional scaling from one side of scaling element 206 to the other. In one example approach, the sealing element 206 is bonded partially or fully to the backing plates 208. Such bonding reduces or prevents leaks from under the scaling elements 206. Such bonding may require replacement of an entire scaling sub assembly during redressing after a scaling operation.

Figure 3E:
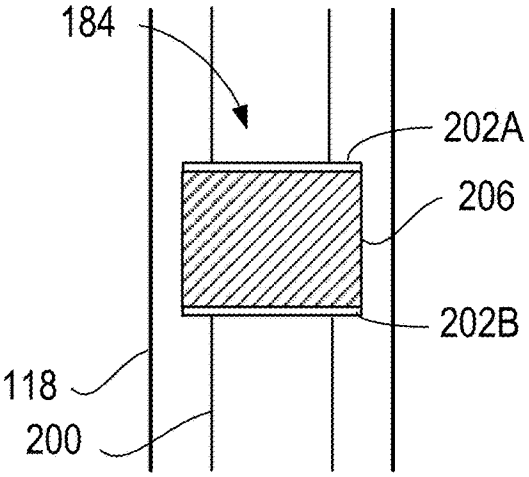
Figure 3F:
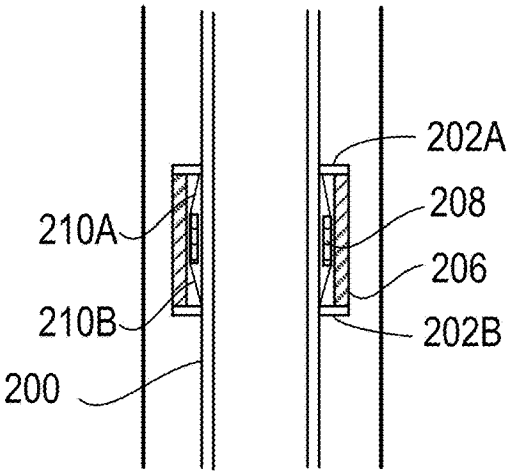
Figure 3C:
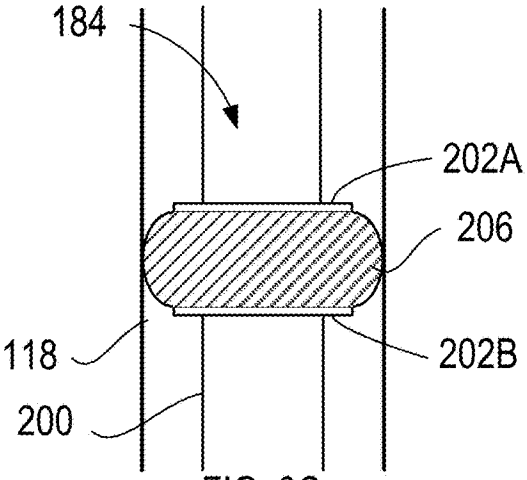

In one example approach of FIG. 2, sealing assembly 184 is a donut seal; the first and second collar sleeves (202A, 202B) are configured to axially slide relative to one another to move the sealing element 206 between the radially retracted state, such as that shown in FIGS. 2, 3A, 3B, 3E and 3F, and a radially expanded state, such as that shown in FIGS. 3C and 3D. As the first collar sleeve 202A moves closer to the second collar sleeve 202B, the backing plate hinges 210A and 210B push the backing plate 208 into sealing element 206, expanding the sealing element 206 into annulus 212 until the sealing element 206 presses against the sides of the wellbore 118, isolating annulus 188 from the portion of the wellbore below the sealing assembly 184. Removal is easy; the collar sleeves 202A and 202B move back to their original unset position, drawing the backing plate 208 back to its original position and allowing the sealing element 206 to relax back into its undeployed position. In one or more example approaches, the axial sliding element and the first collar sleeve 202A are a single combined feature. In some example approaches, one or more anti-extrusion devices such as shoes (not shown) may be used on the sealing assembly 184.

In one example approach, sealing assembly 184 is resettable and reusable; the scaling element 206 may be set and unset repeatedly with minimal damage to elastomers. To set the device, the first collar sleeve 202A slides down toward the second collar sleeve 202B forcing the elastomers to balloon radially. The backing plates 208 extend radially under pressure from hinges 210 to support the elastomers of sealing element 206 from inside. To unset the device, the first collar sleeve slides up to reverse the setting process. This method of retraction does minimal damage to the elastomers, allowing them to be reused. In addition, the backing plate 208 creates additional force on the elastomer improving the seal's performance.

An advantage of the sealing assembly 184 described above is that it is easily deployed and reusable. In some example approaches, the sealing assembly 184 is modular; elements of the scaling assembly are easily replaced when needed. In some example approaches, the method of activation is like existing retrievable bridge plug designs, therefore reducing the need to re-train operators.

Figure 3B:
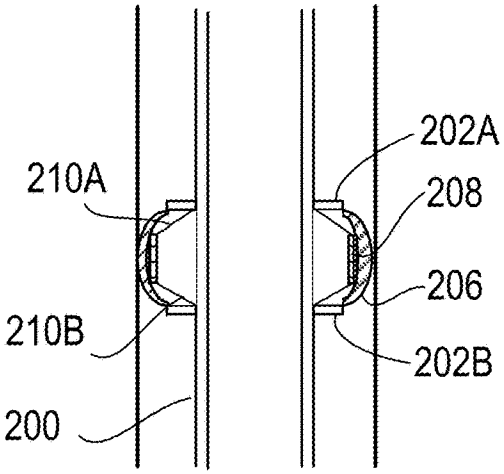
Figure 3A:
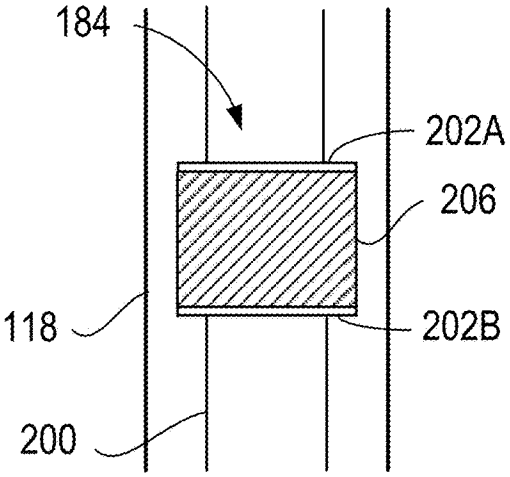
Figure 3B:
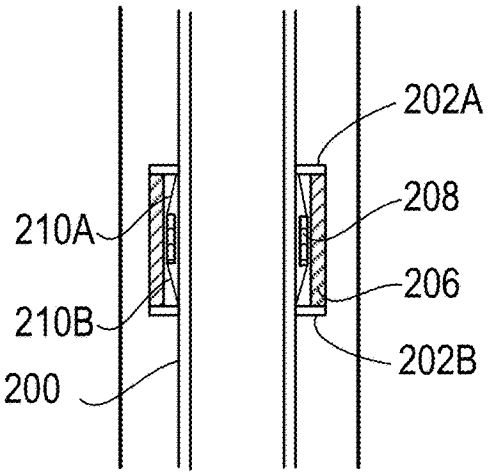

FIGS. 3A-3F are cross-sectional views of deployment states of an example scaling assembly that may be used in the example well system of FIG. 1, according to aspects of the present disclosure. In the example shown in FIGS. 3A and 3B, scaling assembly 184 includes a scaling element 206 connected to a first collar sleeve 202A and to a second collar sleeve 202B. In one example approach, the sealing element 206 is made up of elastomers. In one example approach, as shown in FIGS. 3A and 3B, the unset scaling assembly 184 is placed into position in the interior of the wellbore 118. In the example approach of FIG. 3B, sealing assembly 184 further includes a backing plate 208 connected by backing plate hinges 210 to collar sleeves 202A and 202B. In one example approach, at least one of the collar sleeves is configured to slide closer to the other collar sleeve, while the other collar sleeve is in a fixed location in the sealing assembly 184. To set the seal, the top end ring slides down, simultaneously ballooning the elastomers and extending the backing plates radially.

FIGS. 3C and 3D illustrate the sealing assembly 184 of FIGS. 3A and 3B in the deployed state, according to aspects of the present disclosure. In the example shown in FIGS. 3C and 3D, scaling assembly 184 has scaled the annulus 212 between the scaling assembly 184 and the wellbore 118. As can be seen in FIGS. 3C and 3D, the sealing element 206 is pressed against wellbore 118 and, as can be seen in FIG. 3D, the sealing element is held in place by backing plate 208 and backing plate hinges 210.

As can be seen in FIGS. 3E and 3F, to unset the seal, the top collar sleeve 202A slides back up, retracting the backing plates 208 and allowing the sealing element 206 to relax back to its run-in state. As can be seen in FIGS. 3A-3F, scaling assembly 184 may be completely un-set, returning the sealing element 206 to a configuration approximating its original run-in configuration and therefore reducing any drag when the tool needs to be moved. In some example approaches, scaling assembly 184 may, in a single run, be set in multiple casing sizes and be set multiple times.

Figure 4A:
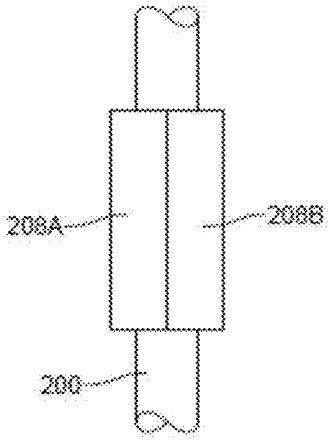
FIGS. 4A-4F are side views of backing plates that may be deployed behind a sealing element in a sealing assembly, for the example well system of FIG. 1, according to aspects of the present disclosure.
Figure 4D:
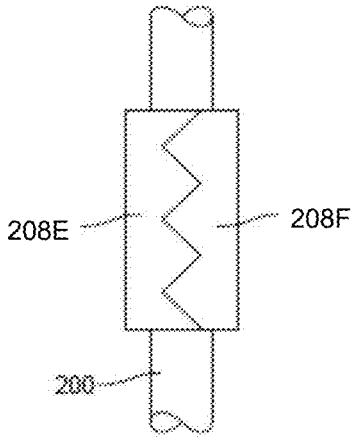
Figure 4B:
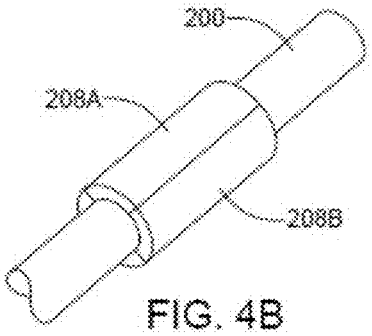

FIGS. 4A, 4D are side views of backing plates that may be deployed behind a scaling element in a scaling assembly, for the example well system of FIG. 1, according to aspects of the present disclosure. In the example approach shown in FIGS. 4A-4C, each backing plate 208 is one of four straight sections of a cylinder that surrounds tubing 200. As can be seen in FIGS. 4A and 4B, in the example show, each backing plate 208 is in a retracted position (such as shown in FIG. 3B) on run-in. As shown in FIG. 4C, each backing plate 208 A-D, when deployed in a scaling state, is pushed away from tubing 200 and against sealing element 206 by backing plate hinges (as shown in FIG. 3D).

Figure 4E:
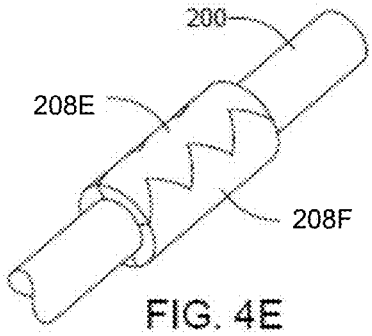
Figure 4C:
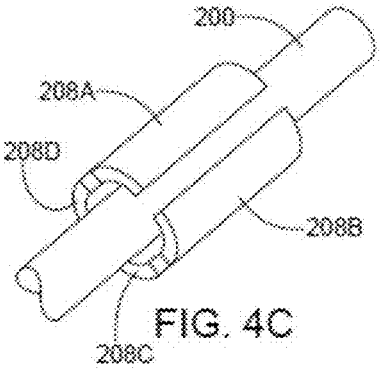
Figure 4F:
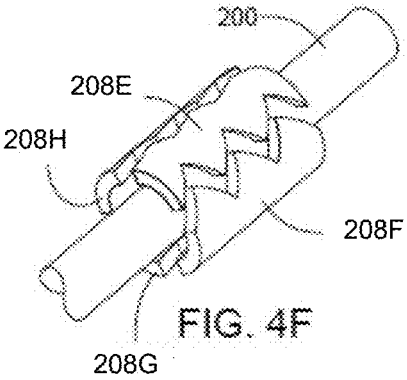

In the example approach shown in FIGS. 4D-4F, each backing plate 208 is one of four sections of a cylinder that surrounds tubing 200. Each section 208E-H has a zig-zag edge. All the zig-zag edges come close together when the backing plates 208 are retracted as shown in FIGS. 4D and 4E. The zig-zag edge may reduce fluid flow between the backing plates 208 when the backing plates 208 are deployed. As shown in FIG. 4F, each backing plate 208, when deployed in a scaling state, is pushed away from tubing 200 and against scaling element 206 by backing plate hinges (as shown in FIG. 3D). Other configurations of backing plates 208 beyond the zig-zag configuration may provide structural or performance enhancements as well. In one example approach, the one or more backing plates 208 include a first, second, third and fourth backing plate arranged around a central axis, wherein adjacent edges of the first, second, third and fourth backing plates 208 are designed to impede fluid flow between the backing plates 208.

Figure 5A:
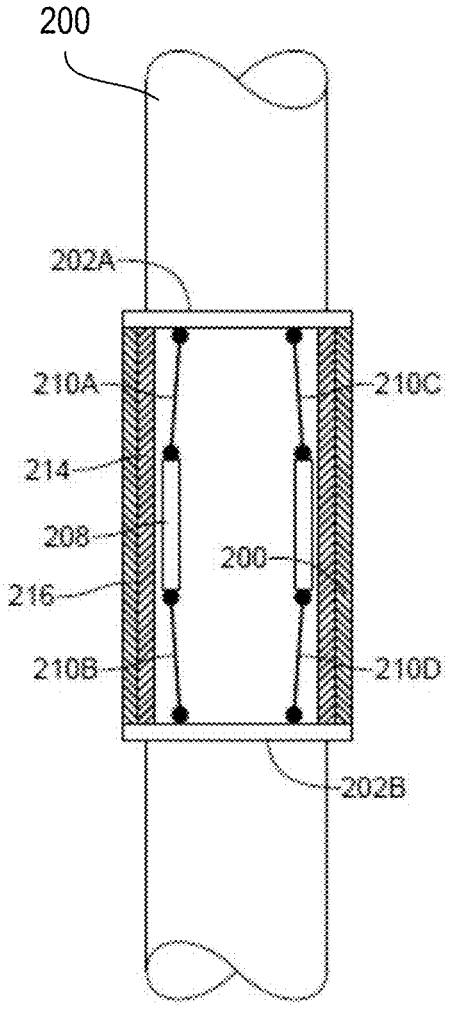
FIGS. 5A and 5B are cross-sectional views of deployment states of another example sealing assembly that may be used in the example well system of FIG. 1, according to aspects of the present disclosure.
Figure 5B:
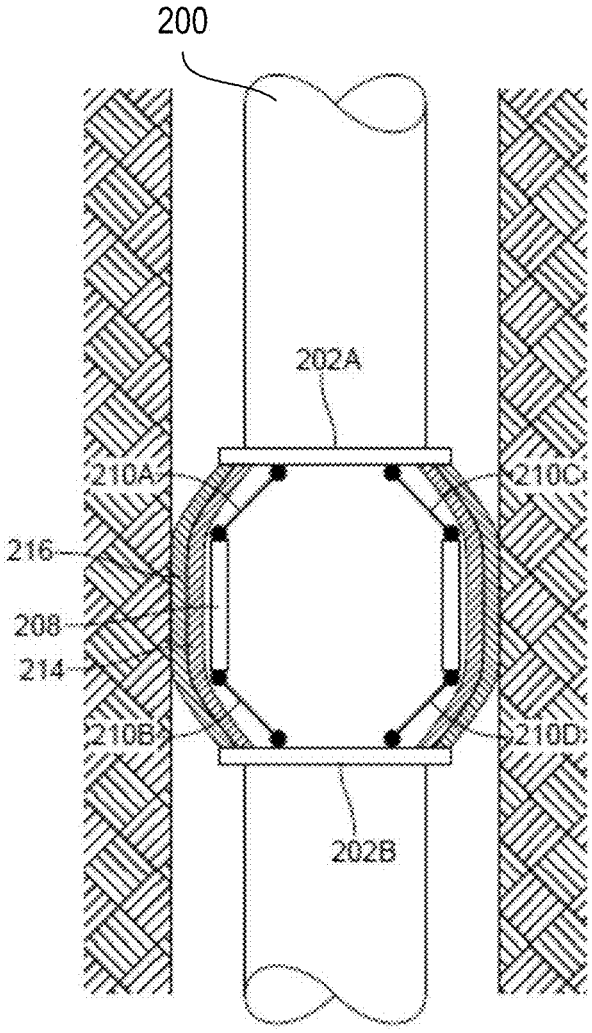

FIGS. 5A and 5B are cross-sectional views of deployment states of another example sealing assembly that may be used in the example well system of FIG. 1, according to aspects of the present disclosure. In the examples shown in FIGS. 5A and 5B, each backing plate 208 is configured as shown in FIG. 4A and positioned next to a surface of sealing element 206. As noted above, sealing element 206 bulges outward as the first collar sleeve 202A slides closer to the second collar sleeve 202B. In some example approaches, the second collar sleeve 202B is in a fixed position and the first collar sleeve 202A slides closer to and away from the second collar sleeve 202B as the sealing assembly sets and resets.

In the example approaches shown in FIGS. 5A and 5B, scaling element 206 includes multiple layers of elastomers, with a tougher inner elastomeric layer 214 adjacent the backing plates 208 and a softer elastomeric outer layer 216 outside the tougher inner layer 214. In some examples, the tougher inner layer 214 provides greater durability to movement by the backing plate 208 while the softer outer layer 216 provides a more secure seal against the wellbore 118.

In the examples shown in FIGS. 5A and 5B, second collar sleeve 202B is fixed in location while first collar sleeve 202A slides relative to second collar sleeve 202B. In the examples shown in FIGS. 5A and 5B, a backing plate hinge 210A is connected between backing plate 208 and first collar sleeve 202A while a backing plate hinge 210B is connected between backing plate 208 and second collar sleeve 202B. As first collar sleeve 202A slides closer to second collar sleeve 202B, the hinges (210A and 210B) push the backing plate 208 into the sealing element 206 and presses the scaling element 206 against wellbore 118, forming a donut seal as shown in FIG. 5B.

FIGS. 6A and 6B are cross-sectional views of deployment states of another hinge combination that may be used in the example scaling assemblies of FIGS. 2, 3A-3F and 5A and 5B, according to aspects of the present disclosure. In the examples shown in FIGS. 6A and 6B, each backing plate 208 is configured as shown in FIG. 4A or 4D and positioned next to a surface of scaling element 206 (not shown). As noted above, sealing element 206 bulges outward as the first collar sleeve 202A slides closer to the second collar sleeve 202B. In some example approaches, the second collar sleeve 202B is in a fixed position and the first collar sleeve 202A slides closer to and away from the second collar sleeve 202B as the sealing assembly sets and resets.

In the examples shown in FIGS. 6A and 6B, second collar sleeve 202B is fixed in location while first collar sleeve 202A slides relative to second collar sleeve 202B. In the examples shown in FIGS. 5A and 5B, a backing plate hinge 310A is connected between backing plate 208 and first collar sleeve 202A while a backing plate hinge 210B is connected between backing plate 208 and second collar sleeve 202B. Backing plate hinge 310A differs from backing plate hinge 210A in that hinge 310A includes a sliding hinge 316 and a fixed hinge 318. In the examples shown in FIGS. 6A and 6B, fixed hinge 318 is connected between a fixed position on mandrel 204 and the end of sliding hinge 316 attached to backing plate 208. As first collar sleeve 202A slides closer to second collar sleeve 202B, the hinges (310A and 210B) keep backing plate 208 parallel to mandrel 204, pushing the backing plate 208 into the sealing element 206 and pressing the sealing element 206 against wellbore 118, forming a donut seal as shown in FIGS. 3C, 3D and 5B.

Figure 7:
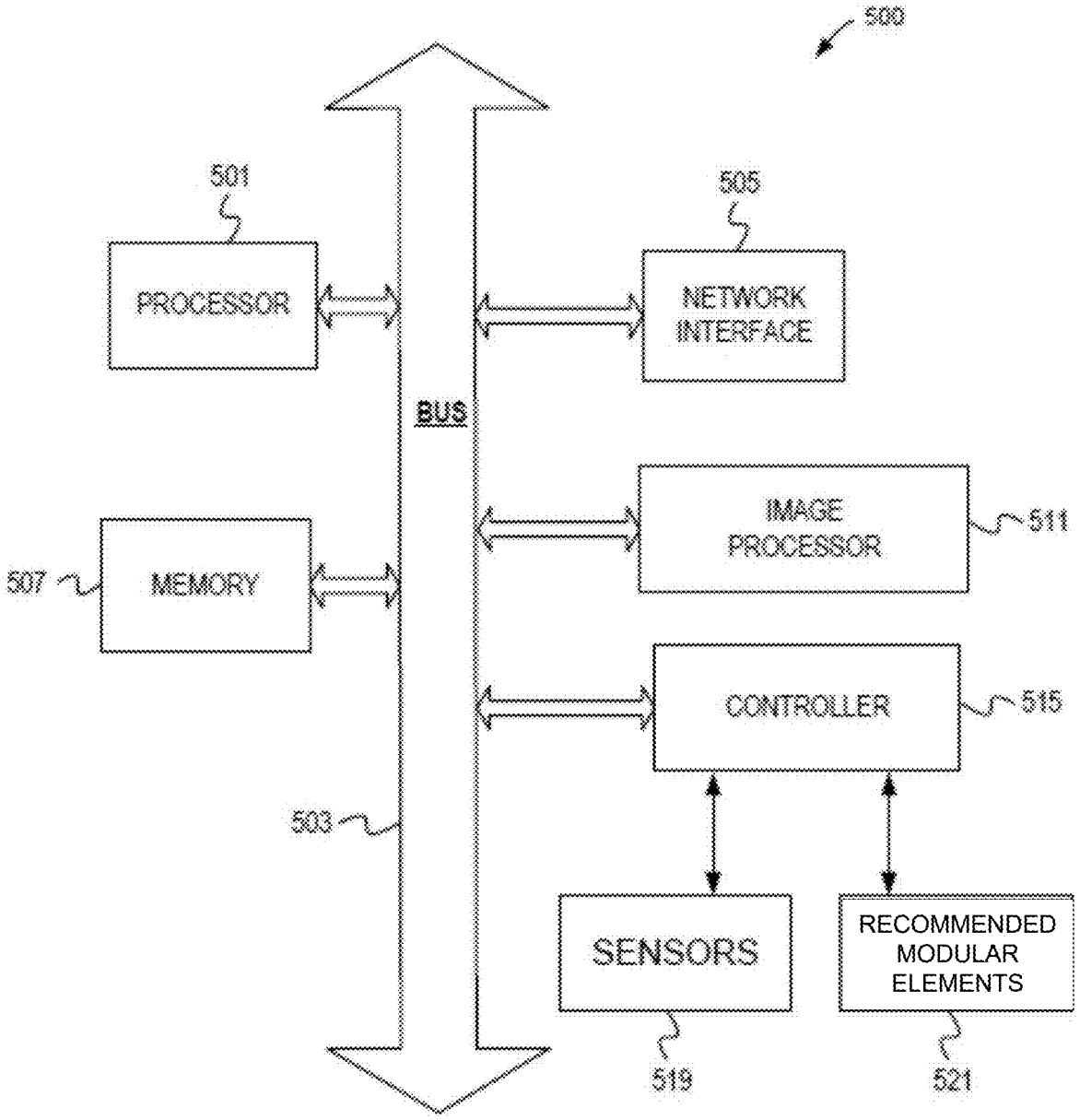
FIG. 7 is a block diagram illustrating a computer system that may be used as part of a sealing assembly in the example well system of FIG. 1, according to aspects of the present disclosure.

FIG. 7 is a block diagram illustrating a computer system that may be used as part of a sealing assembly in the example well system of FIG. 1, according to aspects of the present disclosure. Computer system 500 may be employed to practice the concepts, methods, and techniques disclosed herein, and variations thereof. In one example approach, computer system 500 includes a plurality of components in electrical communication with each other, in some examples using a bus 503. In some example approaches, bus 503 includes one or more of an internal bus such as a PCI, ISA or PCI-Express bus. In some example approaches, bus 103 includes a network interface 505 (e.g., ethernet or Fiber Channel). The computing system 500 may include any suitable computer, controller, or data processing apparatus capable of being programmed to carry out the method and apparatus as further described herein.

In one example approach, computing system 500 may be a general-purpose computer, and may include a processor 501 (possibly including multiple processors, multiple cores, multiple nodes, and/or implementing multi-threading, etc.). In one such example approach, computer system 500 includes a memory 507. The memory 507 may be system memory (e.g., one or more of cache, static random-access memory (SRAM), or dynamic random-access memory (DRAM) or any one or more of the possible realizations of machine-readable media.

The computer may also include an image processor 511 and a controller 515. The controller 515 may control the different operations that can occur in response to data received at sensor inputs 519 and/or calculations based on data received from a controller establishing control of scaling assembly 184 using any of the techniques described herein, and any equivalents thereof. In some example approaches, controller 515 may communicate instructions to the appropriate equipment, devices, etc. used to position and control sealing assembly 184. Any one of the previously described functions may be partially (or entirely) implemented in hardware and/or on the processor 501. For example, the functions may be implemented with an application specific integrated circuit, in logic implemented in the processor 501, in a co-processor on a peripheral device or card, etc. Further, realizations may include fewer or additional components not illustrated in FIG. 7 (e.g., video cards, audio cards, additional network interfaces, peripheral devices, etc.). As illustrated in FIG. 7, the processor 501 and the network interface 505 are coupled to the bus 503. Although illustrated as also being coupled to the bus 503, the memory 507 may be coupled to the processor 501 only, to both processor 501 and bus 503 or to processor 501, image processor 511 and bus 503. Controller 515 may include circuitry, such as analog-to-digital (A/D) converters and buffers that allow controller 515 to receive electrical signals directly from one or more of sensor inputs 519.

In one example approach, processor 501 may be configured to execute instructions that provide control over the drilling and calibration procedures described in this disclosure, and over any equivalents thereof. For example, processor 501 may control operations of a drilling controller during deployment of a scaling assembly 184.

With respect to computing system 500, basic features here may easily be substituted for improved hardware or firmware arrangements as they are developed. In some examples, memory 507 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, may be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 500 or as a general-purpose computer, some example approaches can be any type of device or apparatus to perform operations described herein.

Example Operations

Figure 8:
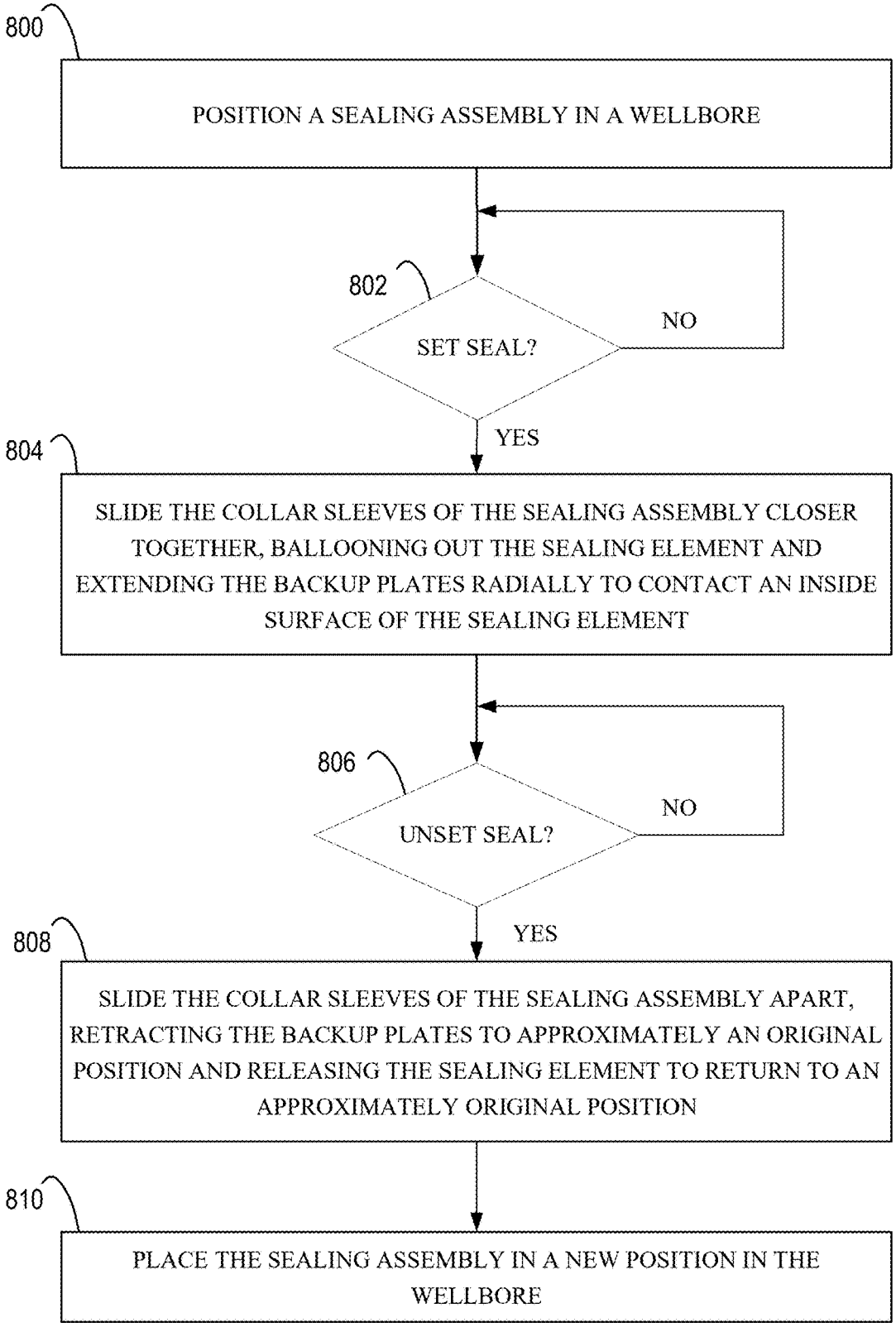
FIG. 8 is a flow chart illustrating a method of deploying a scaling assembly, according to aspects of the present disclosure.

FIG. 8 is a flow chart illustrating a method of deploying a sealing assembly, according to aspects of the present disclosure. In one example approach, a sealing assembly 184 is deployed in a wellbore 118 in a section of the wellbore 118 that is to be sealed (800). In one example approach, a processor such as processor 501 determines, at 802, if the sealing assembly 184 is to be set in position and, if not, processor 501 remains at 802. If, however, a determination is made by processor 501 that the sealing assembly 184 is to be set in its location, one or more of the collar sleeves of the sealing assembly are moved closer to each other, ballooning out the sealing element 206 and extending the backup plates 208 radially to contact an inside surface of the sealing element 206 while the sealing element 206 is in contact with a surface of wellbore 118 (804).

In one example approach, a processor such as processor 501 determines, at 806, if the sealing assembly 184 is to be set in position and, if not, processor 501 remains at 806. If, however, a determination is made by processor 501 that the sealing assembly 184 is to be moved within wellbore 118, slide the collar sleeves 202 apart, retracting the backing plates 208 to an approximately original position and releasing the sealing element 206 to return to an approximately unset position (808). The sealing assembly may then be positioned in a new position in wellbore 118 and sealed once again (810).

The iterative method described in this disclosure may be extended beyond drilling and applied to other contact problems such as those between a flexible beam/column/pipe/string and rigid constraints (such as drill string-wellbore wall contacts, drill string-riser string contacts, casing-wellbore wall contacts, sucker rod-casing contacts). The claims are not intended to be limited to the implementations shown herein but are to be accorded the widest scope consistent with this disclosure, the principles and the novel features disclosed herein.

Additionally, various features that are described in this specification in the context of separate implementations also can be implemented in a single implementation. Conversely, various features that are described in the context of a single implementation also can be implemented in multiple implementations separately or in any suitable subcombination. As such, although features may be described above as acting in combinations, and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the order shown or in sequential order, or that all illustrated operations be performed, to achieve desirable results. Further, the drawings may schematically depict one or more example processes in the form of a flowchart or flow diagram. However, other operations that are not depicted can be incorporated in the example processes that are schematically illustrated. For example, one or more additional operations can be performed before, after, simultaneously, or between any of the illustrated operations. In some circumstances, multitasking and parallel processing may be advantageous.

Moreover, the separation of various system components in the implementations described above should not be understood as requiring such separation in all implementations, and it should be understood that the described program components and systems can generally be integrated together into a single software product or packaged into multiple software products. Additionally, other implementations are within the scope of the following claims. In some cases, the actions recited in the claims can be performed in a different order and still achieve desirable results.

Example Embodiments

Embodiment #1: A sealing assembly having a first collar sleeve, a second collar sleeve positioned a first distance away from the first collar sleeve, a sealing element disposed between the first and second collar sleeves and one or more backing plates disposed behind the sealing element, each backing plate including a first hinge connected to the first collar sleeve and a second hinge connected to the second collar sleeve, wherein the hinges are configured to set the sealing element by pushing the respective backing plate into the sealing element when the first and second collar sleeves are less than the first distance apart and to unset the sealing element as the first and second collar sleeves return to the first distance apart.

Embodiment #2: The sealing assembly of claim 1, wherein the second collar sleeve is at a fixed location in the sealing assembly.

Embodiment #3: The sealing assembly of claim 2, wherein the first collar sleeve is configured to slide closer to the second collar sleeve.

Embodiment #4: The sealing assembly of claim 1, wherein the sealing assembly includes a mandrel, wherein the second hinge is fixed to the mandrel.

Embodiment #5: The sealing assembly of claim 4, wherein the first hinge is a hinge assembly, wherein the hinge assembly includes a hinge that is fixed and a hinge that slides toward the second collar sleeve, keeping the backing plates parallel to the mandrel.

Embodiment #6: The sealing assembly of claim 1, wherein the sealing assembly includes a mandrel, wherein the second hinge is fixed to the mandrel and the first hinge slides along a surface of the mandrel.

Embodiment #7: The sealing assembly of claim 1, wherein the sealing element includes an elastomeric sealing element.

Embodiment #8: The sealing assembly of claim 7, wherein the elastomeric sealing element includes an outer elastomeric layer and a tougher inner elastomeric layer, where the tougher inner elastomeric layer is placed to contact the one or more backing plates when deployed.

Embodiment #9: The sealing assembly of claim 1, wherein the one or more backing plates include a first, second, third and fourth backing plate arranged around a centerline, wherein adjacent edges of the first, second, third and fourth backing plates are designed to impede fluid flow between the backing plates.

Embodiment #10: A well system including a wellbore located in a subterranean formation and a sealing assembly positioned in the wellbore, the sealing assembly including a first collar sleeve, a second collar sleeve positioned a first distance away from the first collar sleeve, a sealing element disposed between the first and second collar sleeves, and one or more backing plates disposed behind the sealing element, each backing plate including a first hinge connected to the first collar sleeve and a second hinge connected to the second collar sleeve, wherein the hinges are configured to set the sealing element by pushing the respective backup plate into the sealing element when the first and second collar sleeves are less than the first distance apart and to unset the sealing element as the first and second collar sleeves return to the first distance apart.

Embodiment #11: The well system of claim 10, wherein the first collar sleeve is configured to slide closer to the second collar sleeve.

Embodiment #12: The well system of claim 10, wherein the sealing assembly includes a mandrel, wherein the second hinge is fixed to the mandrel.

Embodiment #13: The well system of claim 12, wherein the first hinge is a hinge assembly, wherein the hinge assembly includes a hinge that is fixed and a hinge that slides toward the second collar sleeve, keeping the backing plates parallel to the mandrel.

Embodiment #14: The well system of claim 10, wherein the sealing element includes an elastomeric sealing element.

Embodiment #15: The well system of claim 14, wherein the elastomeric sealing element includes a softer outer elastomeric layer and a tougher inner elastomeric layer, where the tougher inner elastomeric layer is placed to contact the one or more backing plates when deployed.

Embodiment #16: A method including positioning a sealing assembly in a wellbore, wherein the sealing assembly includes a first collar sleeve, a second collar sleeve, a sealing element disposed between the first and second collar sleeves, and one or more backing plates disposed behind the sealing element, each backing plate connected to a first hinge connected to the first collar sleeve and to a second hinge connected to the second collar sleeve; sliding the collar sleeves closer together, wherein sliding the collar sleeves closer together sets the sealing element by forcing the sealing element outward and by extending the one or more backing plates to contact an inside surface of the sealing element; and sliding the collar sleeves apart, wherein sliding the collar sleeves apart unsets the sealing element by retracting the one or more backing plates, allowing the sealing element to relax into an approximately original position.

Embodiment #17: The method of claim 16, wherein the second collar sleeve is in a fixed position in the sealing assembly.

Embodiment #18: The method of claim 16, wherein positioning the sealing assembly in the wellbore includes anchoring the sealing assembly in the wellbore.

Embodiment #19: The method of claim 16, wherein the method further comprises positioning the sealing assembly in a new position in the wellbore; and sliding the collar sleeves closer together, wherein sliding the collar sleeves closer together forces the sealing element outward, extends the one or more backing plates to contact an inside surface of the sealing element and seals the sealing element against the wellbore in the new position.

What is claimed is:

1. A sealing assembly, comprising:

a first collar sleeve;

a second collar sleeve positioned a first distance away from the first collar sleeve;

a sealing element disposed between the first and second collar sleeves; and one or more backing plates disposed on an inside surface of the sealing element, each backing plate including a first hinge connected to the first collar sleeve and a second hinge connected to the second collar sleeve, wherein the hinges are configured to set the sealing element by pushing the respective backing plate into the sealing element when the first and second collar sleeves are less than the first distance apart and to unset the sealing element as the first and second collar sleeves return to the first distance apart, wherein the sealing assembly includes a mandrel, wherein the second hinge is fixed to the mandrel, and wherein the first hinge is a hinge assembly, wherein the hinge assembly includes a hinge that is fixed and a hinge that slides toward the second collar sleeve, keeping the backing plates parallel to the mandrel.

2. The sealing assembly of claim 1, wherein the second collar sleeve is at a fixed location in the sealing assembly.

3. The sealing assembly of claim 2, wherein the first collar sleeve is configured to slide closer to the second collar sleeve.

4. The sealing assembly of claim 1, wherein the first hinge is configured to slide along a surface of the mandrel.

5. The sealing assembly of claim 1, wherein the sealing element includes an elastomeric sealing element.

6. The sealing assembly of claim 5, wherein the elastomeric sealing element includes an outer elastomeric layer and a tougher inner elastomeric layer, where the tougher inner elastomeric layer is placed to contact the one or more backing plates when deployed.

7. The sealing assembly of claim 1, wherein the one or more backing plates include a first, second, third and fourth backing plate arranged around a centerline, wherein adjacent edges of the first, second, third and fourth backing plates are designed to impede fluid flow between the backing plates.

8. A well system, comprising:

a wellbore located in a subterranean formation; and a sealing assembly positioned in the wellbore, the sealing assembly including:

a first collar sleeve;

a second collar sleeve positioned a first distance away from the first collar sleeve;

a sealing element disposed between the first and second collar sleeves; and one or more backing plates disposed on an inside surface of the sealing element, each backing plate including a first hinge connected to the first collar sleeve and a second hinge connected to the second collar sleeve, wherein the hinges are configured to set the sealing element by pushing the respective backup plate into the sealing element when the first and second collar sleeves are less than the first distance apart and to unset the sealing element as the first and second collar sleeves return to the first distance apart, wherein the sealing assembly includes a mandrel, wherein the second hinge is fixed to the mandrel, and wherein the first hinge is a hinge assembly, wherein the hinge assembly includes a hinge that is fixed and a hinge that slides toward the second collar sleeve, keeping the backing plates parallel to the mandrel.

9. The well system of claim 8, wherein the first collar sleeve is configured to slide closer to the second collar sleeve.

10. The well system of claim 8, wherein the sealing element includes an elastomeric sealing element.

11. The well system of claim 10, wherein the elastomeric sealing element includes a softer outer elastomeric layer and a tougher inner elastomeric layer, where the tougher inner elastomeric layer is placed to contact the one or more backing plates when deployed.

12. A method comprising:

positioning a sealing assembly in a wellbore, wherein the sealing assembly includes:

a first collar sleeve;

a second collar sleeve;

a sealing element disposed between the first and second collar sleeves; and one or more backing plates disposed on an inside surface of the sealing element, each backing plate connected to a first hinge connected to the first collar sleeve and to a second hinge connected to the second collar sleeve, wherein the sealing assembly includes a mandrel, wherein the second hinge is fixed to the mandrel, and wherein the first hinge is a hinge assembly, wherein the hinge assembly includes a hinge that is fixed and a hinge that slides toward the second collar sleeve, keeping the backing plates parallel to the mandrel;

sliding the collar sleeves closer together, wherein sliding the collar sleeves closer together sets the sealing element by forcing the sealing element outward and by extending the one or more backing plates to contact an inside surface of the sealing element; and sliding the collar sleeves apart, wherein sliding the collar sleeves apart unsets the sealing element by retracting the one or more backing plates, allowing the sealing element to relax into an approximately original position.

13. The method of claim 12, wherein the second collar sleeve is in a fixed position in the sealing assembly.

14. The method of claim 12, wherein positioning the sealing assembly in the wellbore includes anchoring the sealing assembly in the wellbore.

15. The method of claim 12, wherein the method further comprises:

positioning the sealing assembly in a new position in the wellbore; and sliding the collar sleeves closer together, wherein sliding the collar sleeves closer together forces the sealing element outward, extends the one or more backing plates to contact an inside surface of the sealing element and seals the sealing element against the wellbore in the new position.

16. The method of claim 15, wherein positioning the sealing assembly in a new position in the wellbore includes anchoring the sealing assembly in the wellbore at the new position.

* * * * *